United States Patent [19]

Noble

[11] 4,328,571

[45] May 4, 1982

[54] RAPID START OSCILLATOR LATCH

[75] Inventor: Robert T. Noble, Dallas, Tex.

[73] Assignee: Texas Instruments Incorporated, Dallas, Tex.

[21] Appl. No.: 73,153

[22] Filed: Sep. 7, 1979

[51] Int. Cl.[3] ..... G04C 19/00; G04F 5/00; G04B 2/00

[52] U.S. Cl. ..... 368/87; 368/156; 368/204; 331/116 R

[58] Field of Search ..... 58/23 A, 23 AC, 23 BA; 331/108C, 160, 185, 186, 116 R, 116 FE; 368/155, 156, 159, 87, 203

[56] References Cited

U.S. PATENT DOCUMENTS

| | | | |
|---|---|---|---|
| 3,375,466 | 3/1968 | Pratt | 331/160 X |
| 4,039,973 | 8/1977 | Yamashiro | 331/116 FE |
| 4,069,659 | 1/1978 | Harris et al. | 368/87 X |
| 4,103,187 | 7/1978 | Imamura | 368/203 X |

*Primary Examiner*—Vit W. Miska

*Attorney, Agent, or Firm*—Robert D. Marshall, Jr.; Leo N. Heiting; Melvin Sharp

[57] ABSTRACT

A rapid start oscillator latch circuit for avoiding long start up time while maintaining minimum operating power for a crystal oscillator in an electronic watch. The oscillator is operated at a relatively high gain immediately after power is applied and until the oscillator is running, after which the oscillator is caused to operate under the normally preferred conditions. A power up pulse sets a latch and the latch is reset by either a pulse from the prescaler or a manual input. When the latch is set, the oscillator circuit is modified for quick start-up. After the oscillator is running, it activates the prescaler, and after several cycles of clock inputs to the prescaler, an output from the prescaler or a manual input resets the latch and the oscillator is returned to its normal operating condition.

6 Claims, 10 Drawing Figures

RAPID START OSCILLATOR LATCH

BACKGROUND OF THE INVENTION

This invention relates to oscillating systems and more particularly to rapid start-up and stabilization of an oscillating system while maintaining minimum operational power consumption. The invention may be used in an electronic watch, electronic calculator, and analog and digital circuits.

To maximize battery life it is necessary to reduce the required power to operate a crystal oscillator. As the power is reduced towards the absolute minimum, the required time for the oscillator to start increases, requiring in some cases as much as many seconds. The long start-up time can be a considerable manufacturing hindrance and inconvenience.

SUMMARY OF THE INVENTION

In accordance with the present invention, an oscillator is operated at a relatively high gain immediately after power is applied and until the oscillator is stabilized and running, after which the gain is reduced and the oscillator is operated under the normal preferred low power conditions. In a preferred embodiment a power-up pulse sets a latch which increases the gain of the oscillator circuit by modifying the oscillator so that it starts quickly. Once the oscillator is running, it activates a prescaler. After several cycles of clock inputs to the activated prescaler, an output from the prescaler resets the latch, thus removing the modifiers from the oscillator circuits, returning it to the normal preferred low power operational conditions.

The type of modification to the oscillator may vary depending upon the IC technology used. In a preferred embodiment utilizing $I^2L$ circuits, the modification is comprised of injection of more current (than in the normal mode) into the oscillator amplifier.

In an alternative embodiment utilizing CMOS circuits, the modification is comprised of switching in larger transistors or shunting out the series output resistance or both during start-up.

In an additional embodiment, a manual reset of the rapid start latch may be utilized. Thus, the latch would be set when the battery is inserted, and the user would reset the latch by pressing a control button as part of his operating procedure.

BRIEF DESCRIPTION OF THE DRAWINGS

Novel features believed to be characteristic of this invention are set forth in the appended claims. The invention itself, however, as well as other objects and advantages thereof may best be understood when read in conjunction with the following detailed description of illustrated embodiments by reference to the accompanying drawings in which:

DETAILED DESCRIPTION

Figure 1:
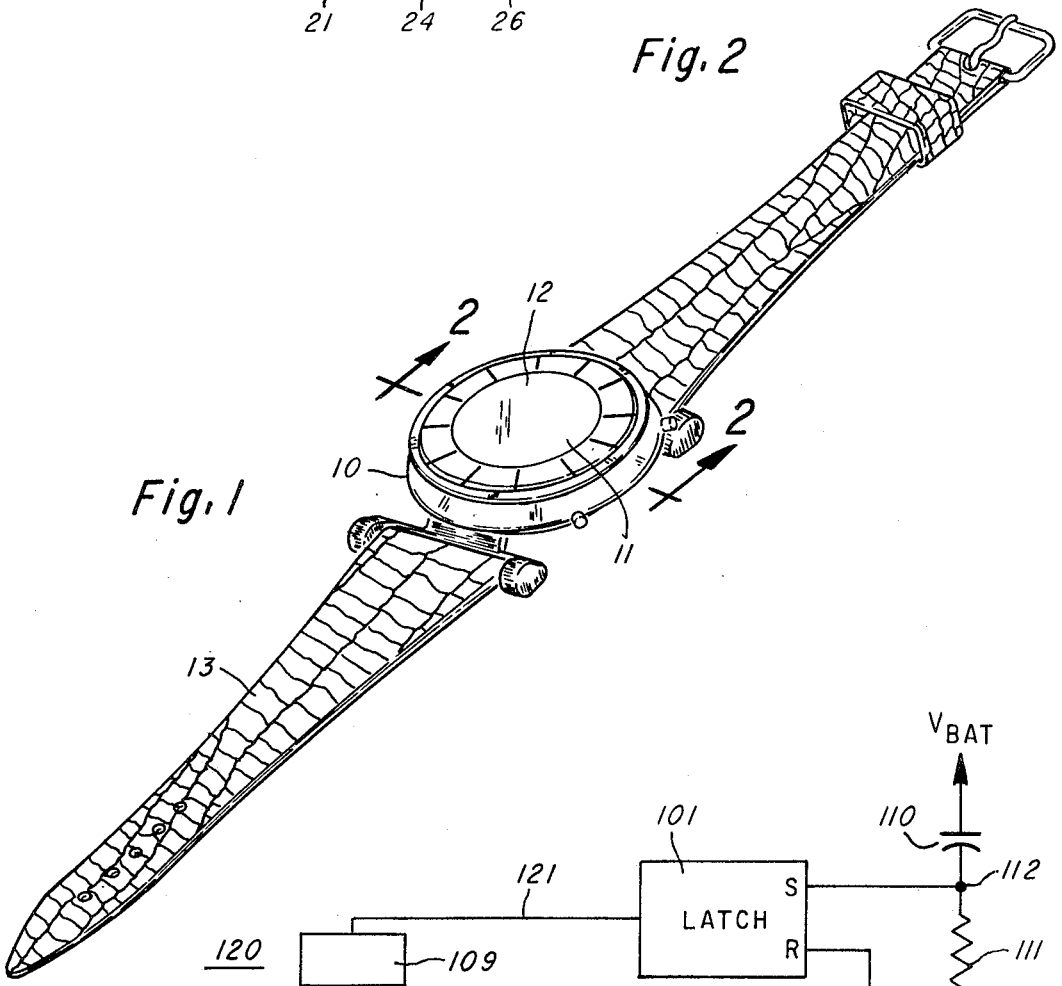
FIG. 1 is a pictoral view of an electronic watch in which oscillator systems embodying the invention may be used advantageously.

Referring to FIG. 1, an electronic watch in which oscillator systems embodying the invention may advantageously be used is shown. A housing 10 is connected to a band 13. A display 11 is seated within the housing 10, with the display 11 being visible through an aperture at the top of the housing 10. A transparent cover 12, overlies the display 11 within the housing 10, the cover 12 providing mechanical and electrical insulation from damage by introduction of foreign objects at the top surface of the housing 10.

Figure 2:
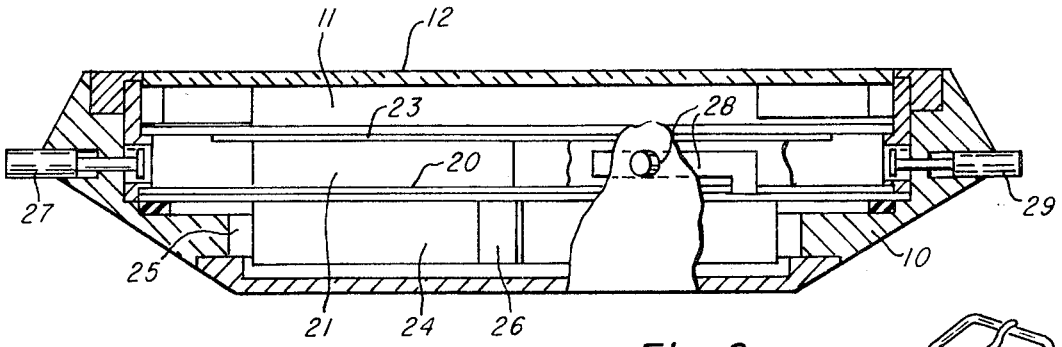
FIG. 2 is an elevational view of the electronic watch of FIG. 1 taken along the line 2—2 of FIG. 1.
Figure 3:
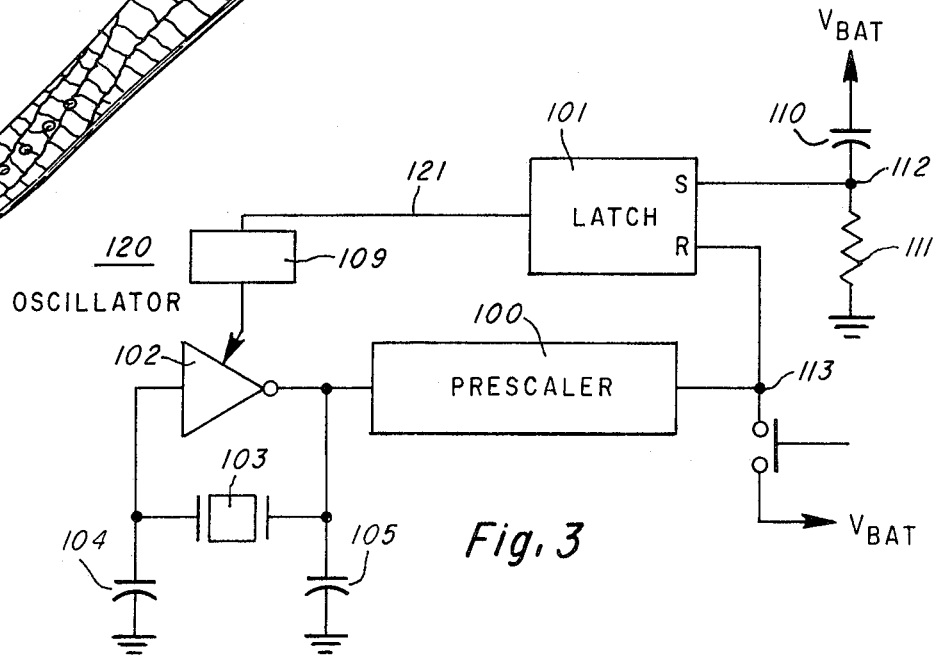
FIG. 3 is a partial block diagram (partial schematic) of an oscillator system embodying the present invention.

Referring to FIG. 2, an elevational view in section of the watch in FIG. 1 is taken along the line 2—2 of FIG. 1. The housing 10 contains a battery compartment 25 in which a battery power source 24 is contained to provide power to the electronic watch system. The battery 24 is connected to an integrated circuit connector 26 which provides for connection of the battery to an integrated circuit 21. A circuit board substrate 20 overlies the battery compartment 25 within the housing 10. The integrated circuit chip 21 is mounted upon and connected to the substrate 20. A protective cover 23 is mounted atop of the integrated circuit chip 21 and connected to the substrate 20. The display 11 is mounted atop the substrate 20 and protective cover 23 within the housing 10. The transparent cover 12 is then mounted on top of the display 11 as previously described with reference to FIG. 1. A first control button 27, a second control button 28, and a third control button 29 are connected to the substrate 20 and therefrom to the integrated circuit chip 21 to allow for user input communication to the integrated circuit chip 21. Referring to FIG. 3, the oscillator 120 is comprised of a selectable gain amplifier 102, a crystal 103, modifier means 109, and capacitors 104 and 105. The output of the oscillator is connected to the input of the prescaler 100. An output of the prescaler 100 is connected to a reset input of a latch 101. A set input of the latch 101 is connected to a node between a resistor 111 and a capacitor 110. The resistor 111 is connected to Vss supply voltage and to the capacitor 110. The capacitor 110 is connected to a Vdd supply voltage and to the resistor 111. The purpose of the resistor 111 and capacitor 110 is to output a pulse of short duration when the battery voltage is first supplied. This short duration voltage pulse sets the latch 101, and the latch 101 when set outputs a signal 121 connected to the modifier means 109 so as to cause an increase in the gain of the amplifier 102. The increase in the gain may be in the form of increased current from a current regulator, as in the case of an $I^2L$ oscillator or it may be in the form of modifying the sizes of the transistors of the oscillators themself so as to increase the current to and gain of the oscillator, such as in the case of $I^2L$, CMOS, or bipolar oscillator.

Two techniques may be used for increasing the loop gain of the oscillator system: (1) to either increase actually or effectively the size of the amplifier transistors, or (2) to reduce the series resistance between the amplifier output and the oscillator output. Many elements are involved in the loop gain. The amplifier transistors determine the inherent gain as well as the required bias voltages to be applied to the amplifier. Another element determinative of gain is the resistance in series with the crystal 103. Any series resistance between the amplifier transistor and the crystal-capacitor network impedes and reduces the signal levels passing through the oscillator output.

Figure 4A:
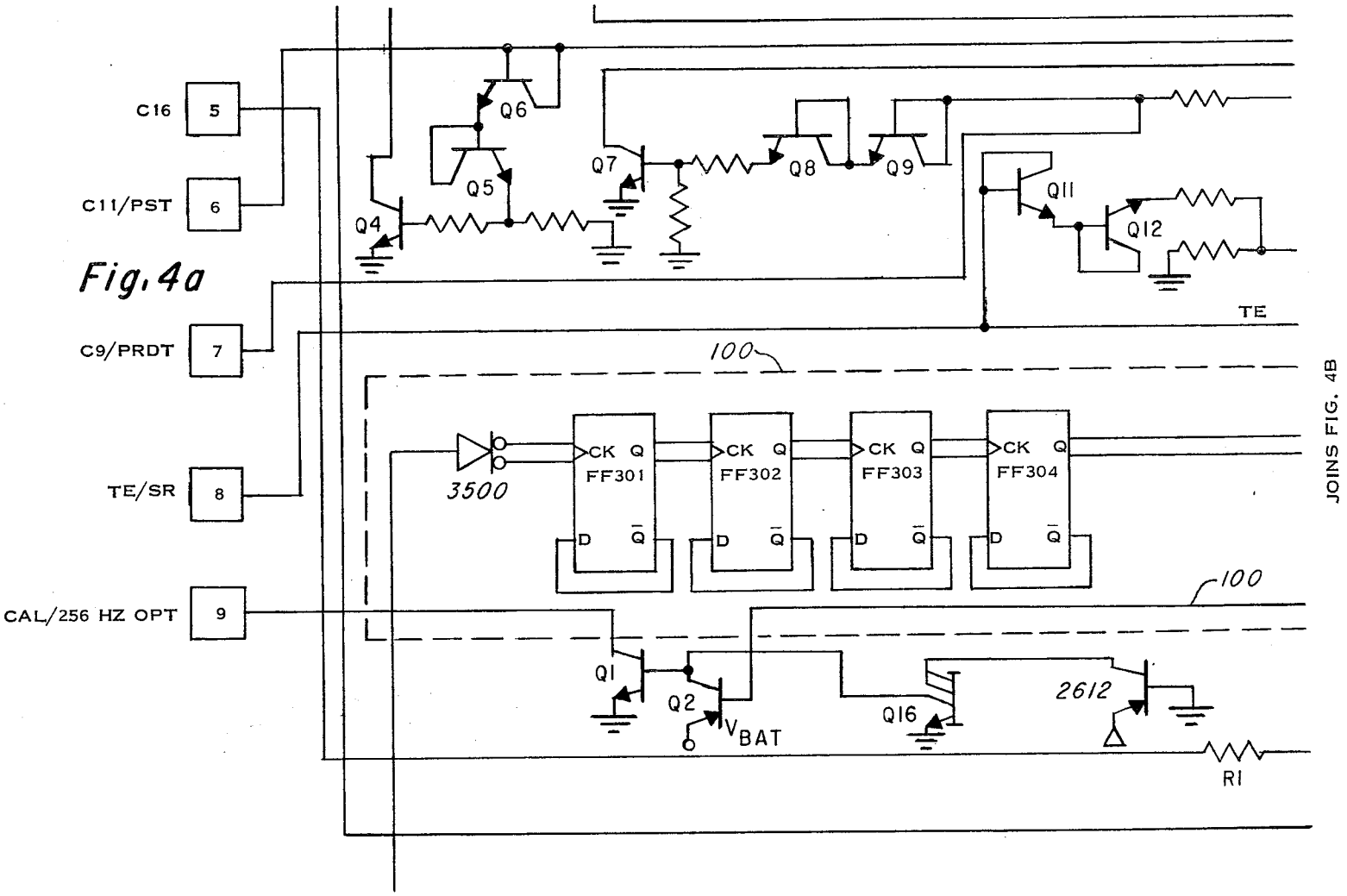
FIGS. 4*a*–4*e* is a schematic diagram of an $I^2L$ embodiment of the present invention of FIG. 3.
Figure 4B:
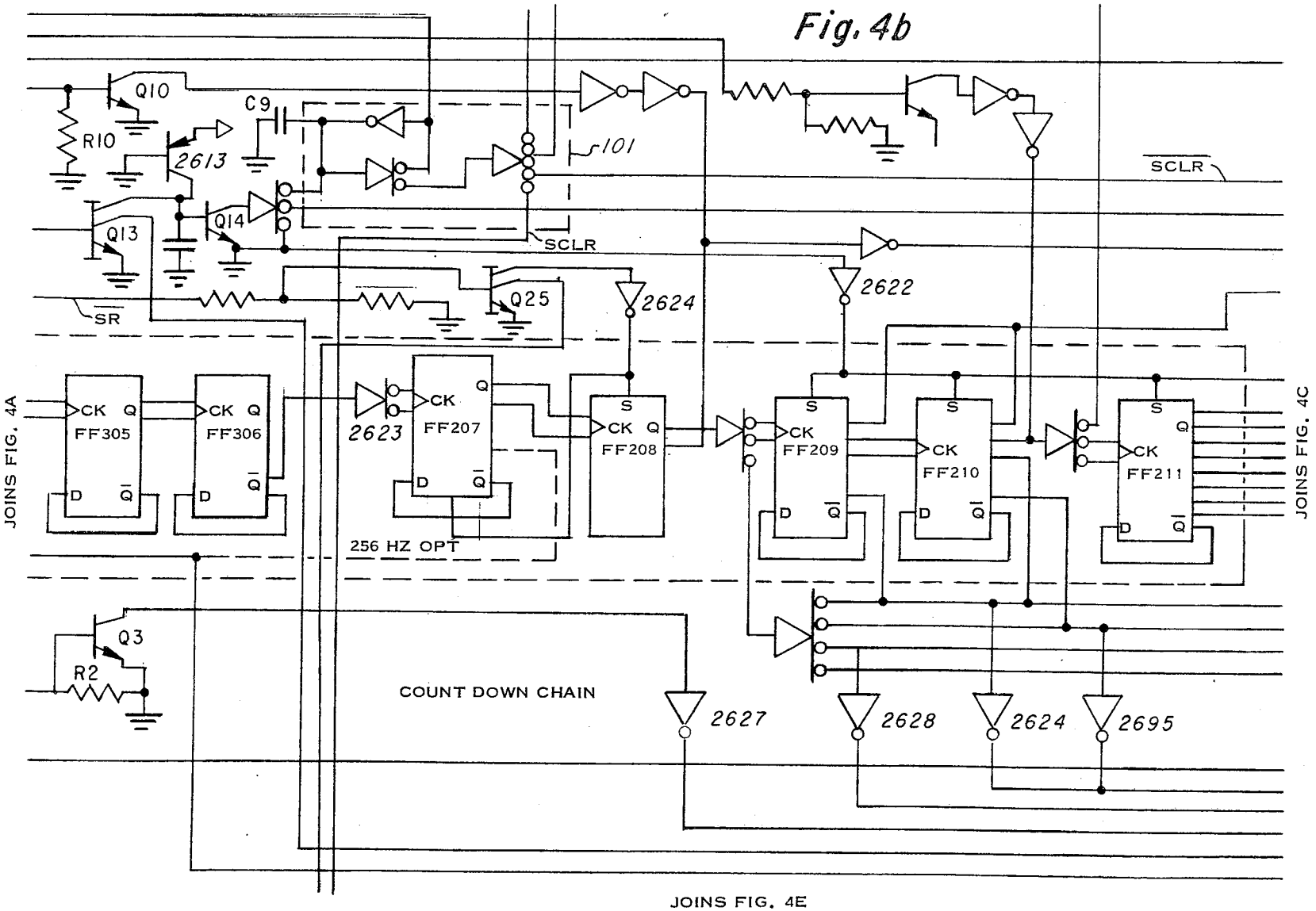
Figure 4C:
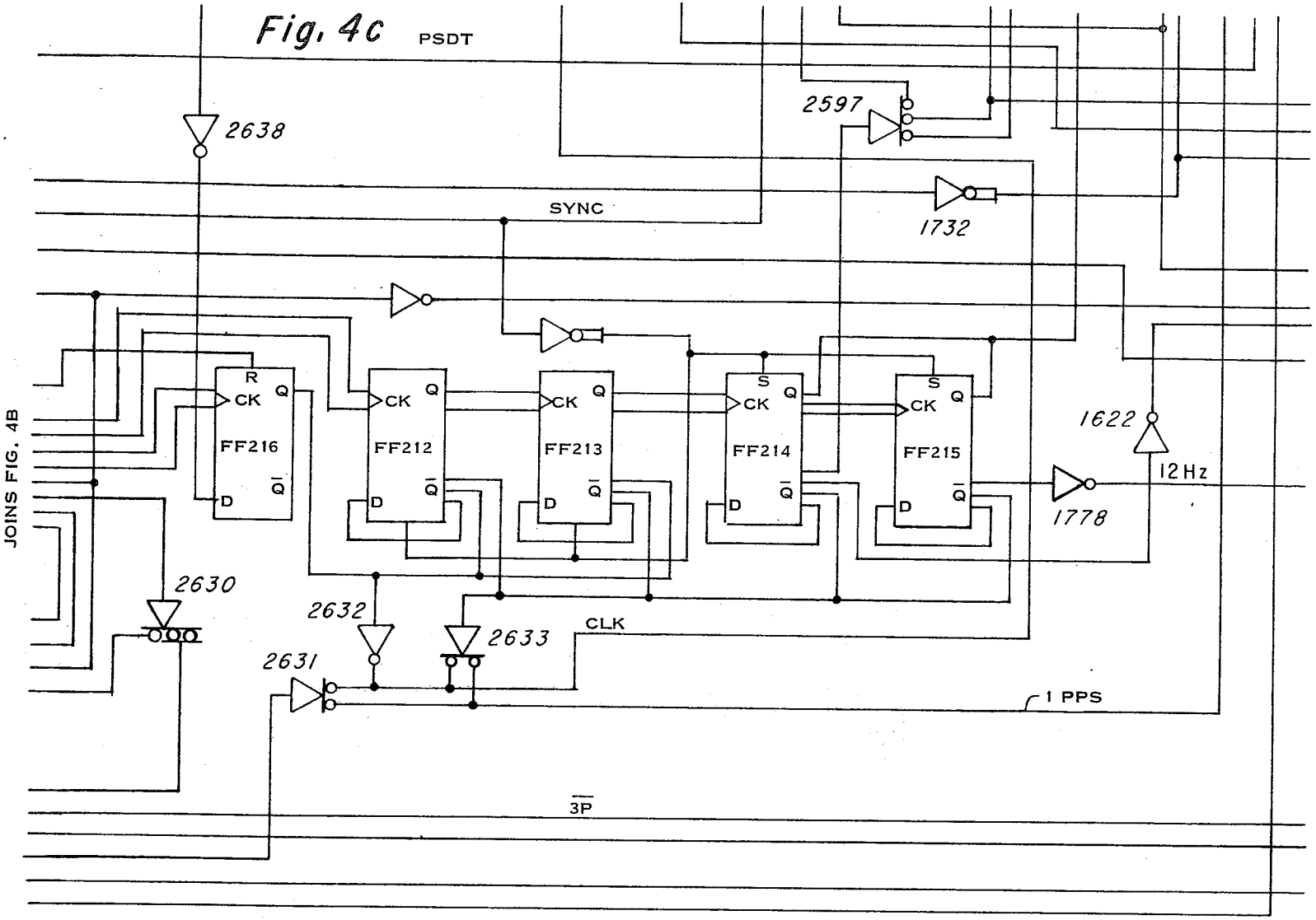
Figure 5A:
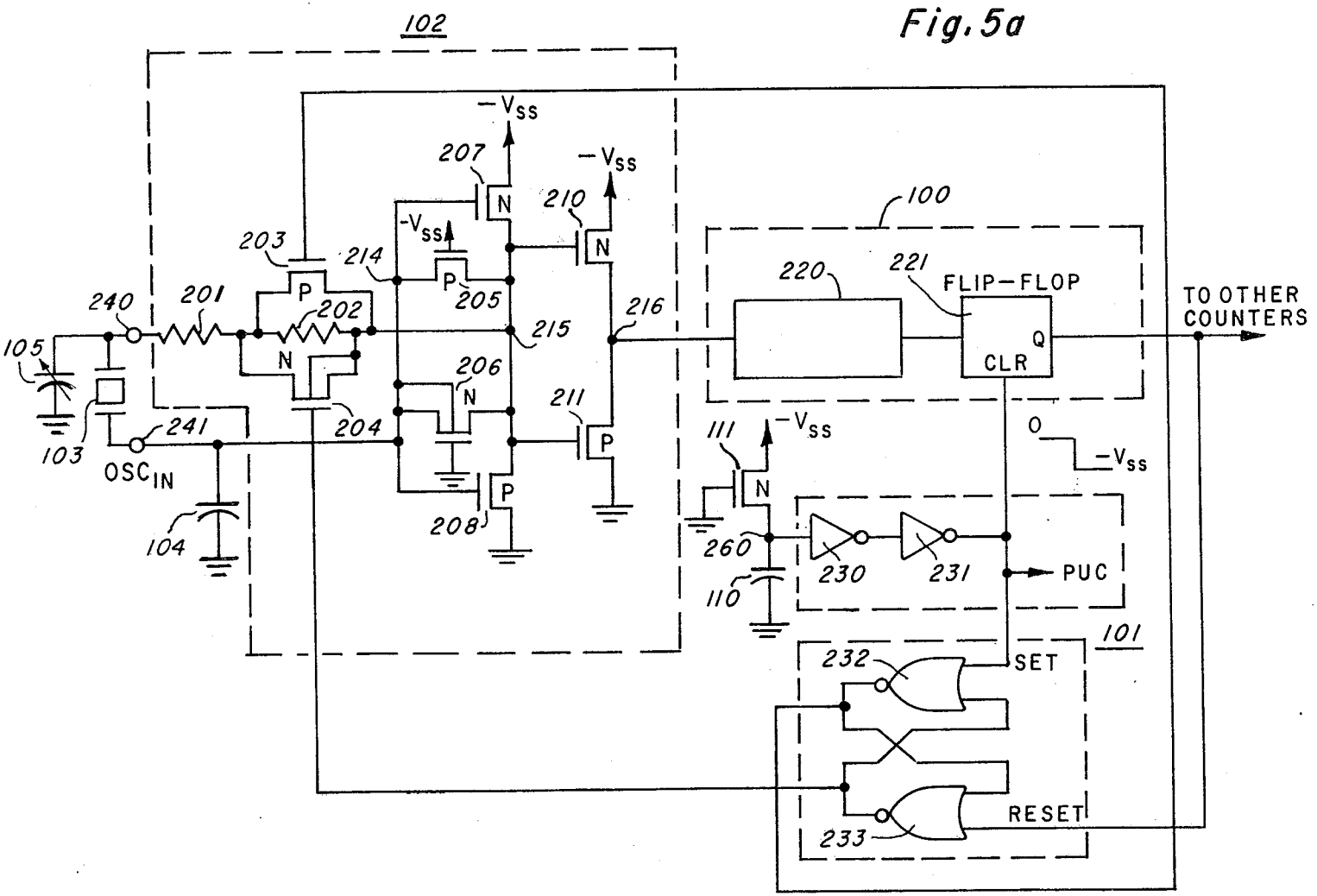
FIGS. 5*a*–5*b* are schematic diagrams of alternative CMOS embodiments of the present invention of FIG. 3.
Figure 5B:
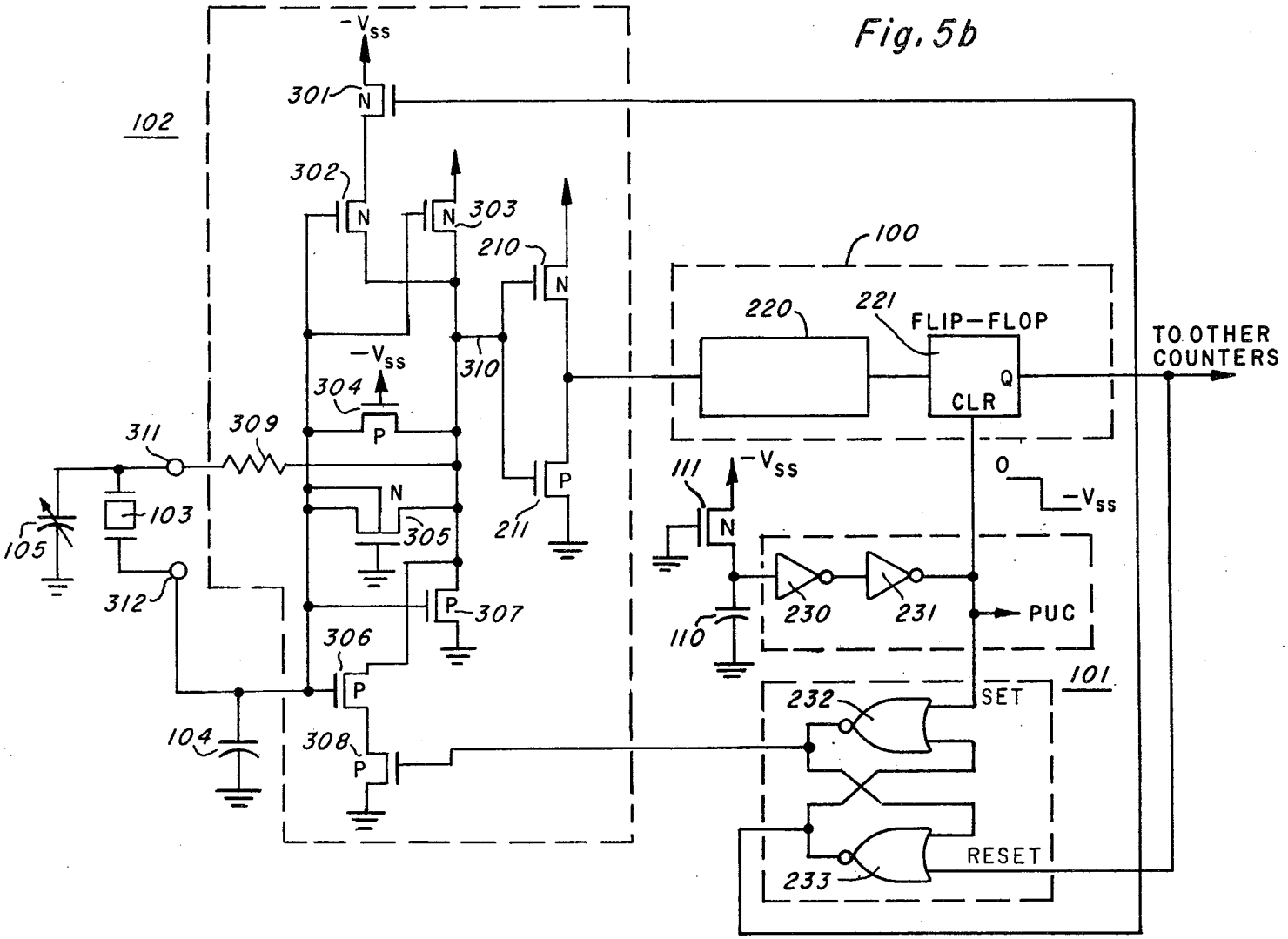

Referring to FIG. 3, when the battery voltage is first applied, capacitor 110 and resistor 111 provide a pulse voltage output at node 112 connected to the S input of the latch 101. When the battery voltage is first applied, there will be no initial charge on the capacitor 110, that is, there will initially be zero volts across the capacitor. When the battery is connected to the oscillator system, the battery side of the capacitor 110 will immediately rise to the battery voltage. Since there is initially no charge or voltage across the capacitor, the resistor side of the capacitor 110 will also immediately rise to the battery voltage, and then, as the capacitor is charged, the resistor side of the capacitor 110 will charge toward the ground voltage. The voltage on the set input S of the latch 101 will have a positive voltage pulse present for a short duration of time proportional to the selected values of the resistor 111 and capacitor 110. By proper value selection of the capacitor 110 and the resistor 111, the pulse duration may be made more than adequate to set the latch. An additional concern is to assure that the battery supply voltage is connected to the latch circuitry quickly during power up so as to allow the latch to be responsive to the set input. Therefore, it is necessary to maintain a positive voltage on the S input long enough to set the latch 101 to a proper On state condition. Additionally, during power up, an inactive, low voltage level, reset signal must be applied to assure proper latch operation. A form of preconditioning on the output of the prescaler 100 is required, to assure that the reset output from the prescaler 100 connecting to the reset input of the power up latch 101 is at an inactive low voltage level during power up. One technique of assuring an inactive low voltage level reset signal during power up is to use the set S input to the latch 101 to simultaneously clear out the latter or all stages of the prescaler 100, as shown in FIG. 4*b* and FIGS. 5*a*–5*b*, so as to assure that the reset output of the prescaler 100 is at a low voltage inactive level as long as the set input to the latch 101 is at an active level. When the latch 101 is set, an output from the latch 101 is connected to the modifier 109 which causes the oscillator system to be modified for fast start up operation. The modification enables means for increasing the gain of the amplifier such that the oscillator will start rapidly. Once the oscillator is started, the prescaler 100 will be clocked by the output of the oscillator, and after a certain number of pulses, determined by the length of the prescaler 100, the output of the prescaler 100 will go high, which in turn is connected to the reset input R of the latch 101, and clears the latch 101, causing the output of the latch 101 to switch to an off state, thereby disabling the modifying means 109 of the oscillator system 120 thereby decreasing the gain of the amplifier 102 to a predetermined low level gain mode. The oscillator 120 then returns to a sustaining condition of low power, low current drain mode. Alternatively, the latch 101 may be reset by a manually supplied input stimulus applied to node 113 and connected to the reset input R of the latch 101 which decreases the gain of the amplifier 102 to the predetermined low level gain mode.

At the resonant frequency of the crystal 103, oscillation will occur only when the total loop gain of the oscillator system is greater than one. If the gain of the system is less than one, then the gain for the amplifier in the system must be increased to compensate for losses in the other circuitry of the system. One way to make the gain greater is to make the transistors in the amplifier physically larger especially in the case of MOS designs. Another more direct way to increase the gain of the amplifier in the oscillator system in the case of bipolar ($I^2L$) designs is to increase the collector/emitter (source/drain) current of the transistors in the amplifier.

Figure 4D:
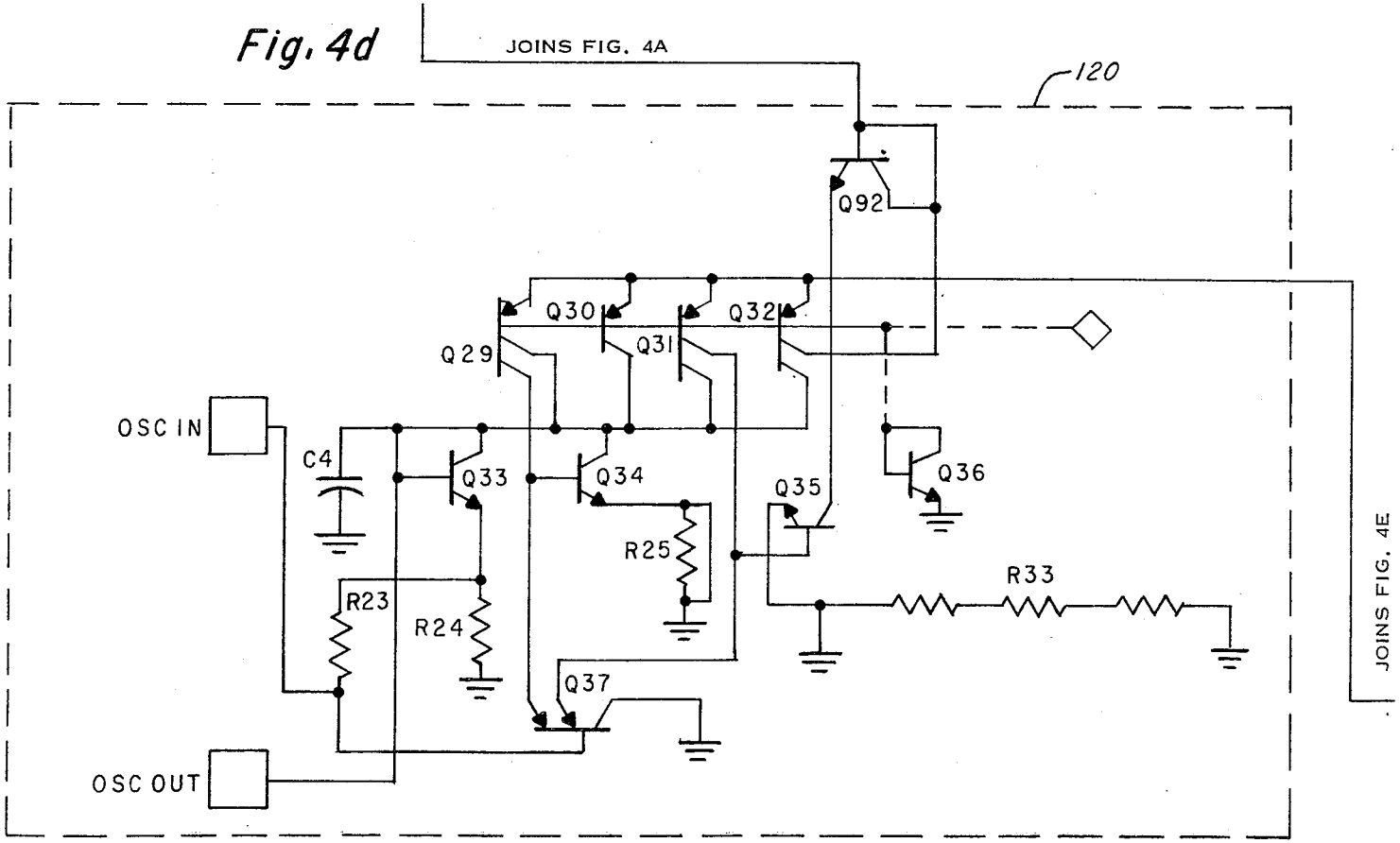
Figure 4E:
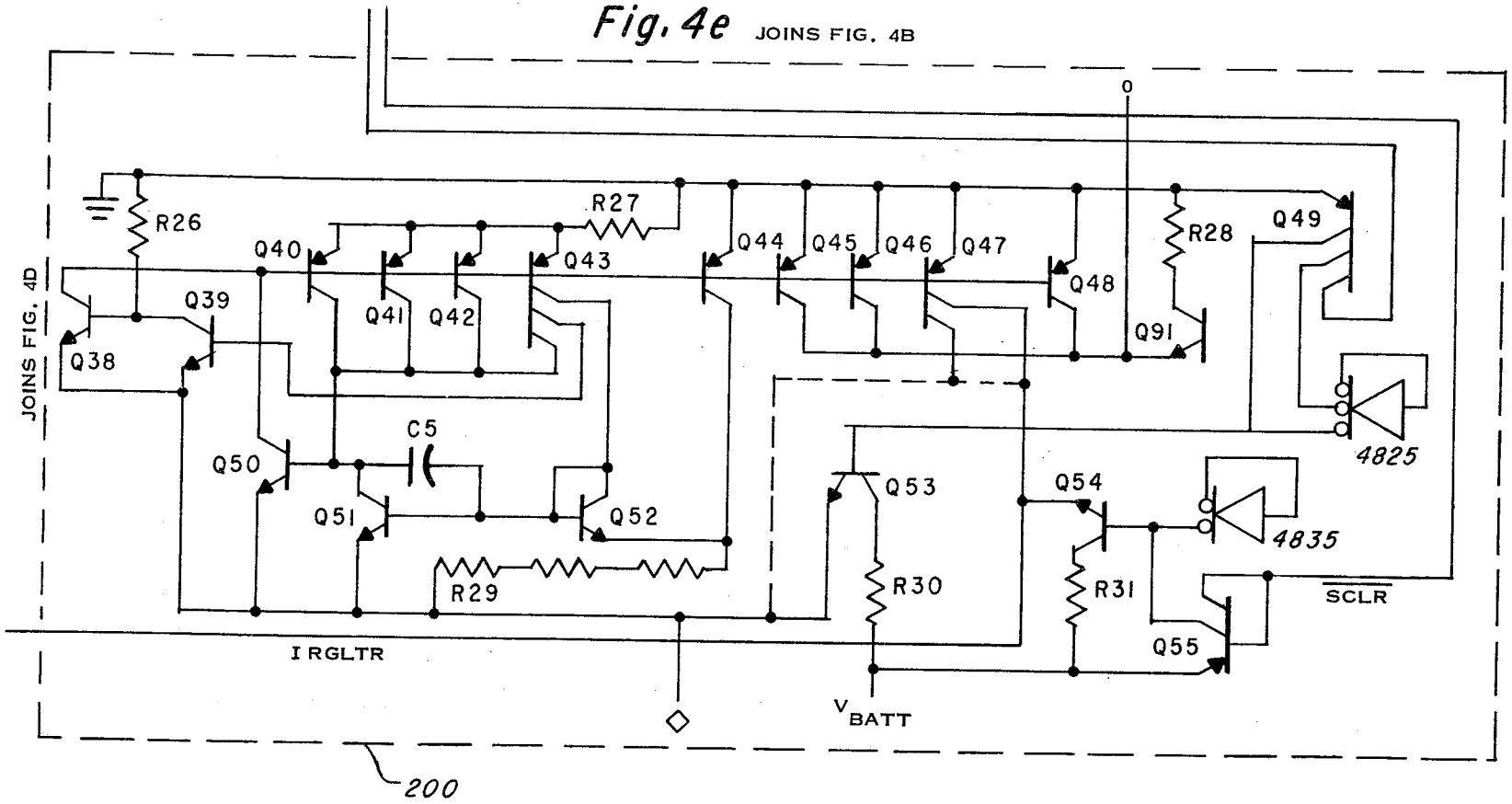

Referring to FIG. 4*d*, increasing the collector/emitter current of amplifier transistor Q34 increases the gain for the amplifier. Transistors Q35 and Q37 are parmetrically and physically matched to the transistor Q34 so as to achieve efficient coupling between the transistors Q34, Q35 and Q37 which form the body of the amplifier 102. By increasing the current through Q34, the current through Q35 and Q37 is increased proportionately. Referring to FIG. 4*e*, the current regulator 200 provides the current supply to the oscillator 120 of FIG. 4*d*. By increasing the current output from the regulator 200, the current to transistors Q29 to Q32 of FIG. 4*d* is increased. Referring back to FIG. 4*d*, a current division network circuit is formed by transistors Q29 through Q32. The ratios of the current division are established to provide for an optimum relationship between transistors Q34, Q35 and Q37. To increase the current in Q34, the current to the entire oscillator must be increased so as to still maintain the proper current ratios with respect to the transistors Q35 and Q37. This is accomplished by increasing the current output from transistor Q47 of the current regulator 200, as shown in FIG. 4*e*. In order to minimize the current drain on the battery or power supply in the system, the oscillator current must be minimized during normal operation. There is a minimum point to which the oscillator current can be reduced. Below that minimum point there is inadequate gain for the oscillator to sustain resonant oscillation. On the other hand, the oscillator should have adequate operational current margins, particularly with regard to turning on quickly and sustaining oscillation. In many applications, for instance in watch circuits, the oscillator can sustain oscillation at very low currents because the Q of the crystal in the oscillator is quite high. However, if the current is reduced to the absolute operational minimum so that oscillation is still mantained, start-up of oscillation will be very slow, which is undersirable and inconvenient. The current to the oscillator 120 must be supplied at a greater level to start up oscillation quickly than the minimum current required for oscillation. However, the start up current may be unacceptable as an operational current due to the excessive power drain. In the present invention, optimization is achieved by switching in higher current during start up of the oscillator, and then reducing that current to a minimum operational level to sustain oscillation thereafter. This effects fast oscillator start up while minimizing the overall current drain because most of the operational life of the battery is working at a minimum current level.

Referring to FIG. 4*e*, the switching of the currents is accomplished through the use of current regulator transistors Q54, Q55, resistor R31, and gate 4835. Normally, the current for the oscillator is supplied from a current regulator 200 by transistor Q47. The transistor Q47 is a pnp transistor which divides the current from the battery in combination with transistors Q44, Q45, Q46 and Q48 to provide current to the various portions of the total circuit. As shown in FIG. 4*e*, the current is divided one of five ways. Q44 supplies current to a regulating circuit which is formed by transistor Q52, resistor R29, transistor Q51 and associated circuitry. The voltage drop across R29 is detected by Q51 and Q52 to maintain a constant current output through the transistor Q44. The current through Q45, Q46, Q47 and Q48 will be proportional to that in Q44 due to physical sizing similarity and design. The current output from Q47 is approximately 1/5 of the total current during normal operation. Thus, if the battery provides a total of 4 microamperes then the oscillator would be operating in the low gain mode 1/5 of the total current, or 0.8 microamperes during normal operations.

When the battery is first connected to the integrated circuit, a power clear latch 101 is set, and the latch 101 outputs a signal $\overline{\text{SCLR}}$, which is an active low output connecting to and turning on the pnp transistor Q55, which then, in turn, supplies current to npn transistor Q54, so as to turn on transistor Q54. Since the collector of Q54 is connected to resistor R31 and therefrom directly to the battery, additional current is supplied to the oscillator 120 in parallel to that supplied from transistor Q47 in the high gain mode. This additional current may be significantly greater than that supplied by Q47, on the order of 50 to 75 microamps. With this significantly increased start up current supplied to the oscillator 120, the gain of the amplifier 102 will be substantially greater than the normal mode oscillation current, and will be more than sufficient to quickly turn on the oscillator within 1 second, typically less than 0.5 seconds. If the transistors Q54 and Q55 had not switched in this additional start up current, the normal operational current of 0.8 microamperes would start up the oscillator in a much greater time than 1 second, and in the limit where operation of the oscillator is attempted at as low as 0.5 microamperes, the turn on time may be on the order of 5 to 15 seconds. In one embodiment, the $\overline{\text{SCLR}}$ signal is removed by pressing the command button 28, which resets the power clear latch 101, switching the $\overline{\text{SCLR}}$ signal to an inactive high level which turns the pnp transistor Q55 to an off state. When Q55 turns off, the gate 4835 pulls the base of transistor Q54 to a low level turning Q54 off, such that the current for the oscillator 120 is supplied solely by Q47 which is at the sustaining current of 0.5 to 0.8 microamperes in the preferred embodiment. This provides the sustaining current to maintain oscillation once the oscillator has stablized at resonant frequency.

When a battery is first inserted into the watch, the user may check to verify that the display is activated by pressing the command button 28. The display cannot be activated unless the oscillator 120 is running so that the oscillator 120 has achieved a stablized state by time the additional power up current is removed.

An alternative method of clearing the power clear latch 101, and thereby removing the additional start up current, is to use an output from the prescaler 100 to reset the latch 101. The prescaler 100 will not be activated unless the oscillator is running. If an output of the prescaler 100, adequately far down the divider chain of the prescaler 100, is chosen as a reset signal to reset the latch 101, the oscillator 120 will have been operational for many cycles prior to the reset signal, and the oscillator 120 will have achieved a stablized state. Thus, there would be no operating problems upon the removal of the additional start up current. This technique provides a means of automatically clearing the latch 100 without having to press the button 28. For example, an auto/reset signal could be tapped from FF306 or FF207 of the prescaler 100 as shown in FIG. 4*b* to reset the power clear latch after 64 or 128 cycles, respectively, thereby deactivating the $\overline{\text{SCLR}}$ signal thereby removing the additional power up current from the oscillator 120.

Referring to FIGS. 5*a–b*, the blocks of FIG. 3 are shown in detailed schematics of CMOS embodiments, with corresponding blocks of FIG. 3 shown with corresponding numbers in FIGS. 5*a–b*. Referring to FIG. 5*a*, the amplifier 102 for the oscillator 120 is comprised of N-channel transistors, 207, 210, 204 and 206, and P-channel transistors 203, 205, 211 and 208, and resistors 201 and 202. The basic amplifier is formed by N-channel transistor 207 and P-channel transistor 208. Transistor 205 and transistor 206 have large length to width ratios, being long skinny devices used for the purpose of biasing the amplifier transistors 207 and 208 into a linear operating range. Transistors 205 and 206 have large length to width ratios to achieve very high impedence, typically in the range of 10–20 megaohm region, in order to prevent loading of the crystal 103. The transistors 205 and 206 are in parallel with each other, forming a resistive element connecting at a node 215 joining between the drains of transisitors 207 and 208. The gates of transistors 207 and 208 are connected to a node 214. Transistors 210 and 211 each have a gate connected to the node 215 and form a buffer between the output of transistors 207 and 208 at the node 215 to the input of the prescaler 100 at a node 216. The resistors 201 and 202 are connected in series between node 215 and an oscillator output node 240. In addition, there is an input capacitor 104 connected to oscillator input node 241. The crystal 103 is connected between the oscillator input node 241 and the oscillator output node 240. A trimmer capacitor 105 is connected to the output node 240 and to ground. The capacitor 105 forms a load for the crystal in conjunction with the capacitor 104. The capacitor value of 105 may be changed, allowing the system to be fine tuned to the preferred resonant frequency. The addition of transistors 203 and 204 for the oscillator system provide a means for selectively shunting out a portion of the amplifier series output resistance as formed by resistor elements 201 and 202. As shown in FIG. 5*a*, when enabled, transistors 203 and 204 will shunt out resistive element 202, which in effect increases the gain of the amplifier 102 in the oscillator system 120. Resistors 201 and 202 are in the circuit to minimize the current drain of the oscillator in the normal oscillation mode, limiting the charging current for the capacitor 105. When the resistor 202 is shunted out of the oscillator circuit, the N-channel transistor 207 will charge the capacitor 105 towards the battery voltage, during one-half of the oscillator clock cycle and P-channel transistor 208 will discharge capacitor 105 towards ground during the other one-half cycle. This charge current is far more than is needed to maintain the oscillation of the oscillator system once stable oscillation has been achieved. Consequently, there is a considerable amount of current, and power which would be wasted if the oscillator were continuously operated under these conditions. Therefore, as a means of reducing the current to minimum operational levels the series output resistor 202 is re-inserted, in effect, between the transistor amplifier 102 and the oscillator output node 240 during sustained normal operation of the oscillator in order to limit the amount of current charging the capacitor 105. A consequence of adding series output resistors is that there is a resistance in series with the resonant circuit which consumes energy from the amplifier, and which is never effectively used in the resonant oscillation network. Thus, there is a compromise between inserting enough series resistance to reduce the current usage, and between not inserting too large a resistance so as to reduce the energy output from the oscillator to a level which would result in oscillator stoppage or lack of oscillator startup. To minimize the current drain, it is necessary that the resistor combination 201 and 202 be as large as possible, but in order for the oscillator to turn on quickly it is necessary that the series resistance be as small as possible. The present invention allows utilization of a large resistance to minimize current during sustained oscillation, and provides a means to greatly reduce the series resistance to a much smaller value during an initial start up period so that the oscillator will start oscillation quickly. The decrease in series resistance is accomplished by effectively shorting out one of the resistors in the series resistance path, in the present case resistor 202, by using parallel transistors 203 and 204 to shunt the resistor 202. A parallel transistor combination is used, P-channel 203 and N-channel 204, such that equal conduction is achieved in both directions, allowing current to flow in both directions so as to allow full oscillation. Transistors 203 and 204 are turned on by the output of latch 101, and more specifically, by the output of NOR gates 232 and 233 which form the cross coupled latch 101. One input of NOR gate 232 is connected to a power up clear signal PUC which is output from an inverter 231. The PUC signal may also be connected to a clear input of a divide by two flip-flop 221 forming the final stage of the prescaler 100, and may be connected to other portions of the circuit as are required to be cleared during the initial application of power. The input of inverter 231 is connected to the output of an inverter 230. The input of the inverter 230 is connected to the junction 260 of the connection of capacitor 110 and the drain of N-channel transistor 111. The transistor 111 corresponds to the resistor 111 of FIG. 3, having formed a resistor with an appropriately sized transistor to get the desired resistance. When power is first applied, a PUC pulse will be initially high, at zero volts, and will then return to a low, minus VSS, voltage. When PUC is high, it sets the cross coupled latch 101. This forces the output of NOR gate 232 to go to a low voltage level, which is connected to the gate of the P-channel transistor 203, which turns on transistor 203, thereby shunting resistor 202. Simultaneously, NOR gate 233 is turned on, causing its output to go to a high voltage level, which is connected to the gate of N-channel transistor 204, turning on transistor 204 and shunting resistor 202. The transistors 203 and 204 are thus both enabled simultaneously, providing a bilateral gate to shunt resistor 202, thereby increasing the gain of the oscillator system by decreasing the limiting resistance between the amplifier output at the node 215 and the oscillator output at the node 240. The node 215 is connected to the gate of N-channel transistor 210 and P-channel transistor 211 which forms a buffer. The output node 216 of the buffer is connected to the clock input of the prescaler 100, and more specifically to the clock input of a first stage 220 of the prescaler 100. The first stage 220 of the prescaler 100 plus the divide by two flip-flop 221 of the prescaler 100 correspond to the prescaler 100 as shown in FIG. 3. Prescaler 100 functions have been separated into a first stage prescaler section 220 in which, in the present embodiment, it is immaterial as to whether the stage 220 has a clear input, and a latter stage 221 that does have a clear input. The Q output of flip flop 221 is connected to the reset input of the latch 101. The Q output of flip flop 221 is required to be at a known state during power-up start up so that a PUC pulse can set the cross coupled latch 101. In order to set the latch, there must not be a conflicting reset signal when the PUC set signal is applied. That is, because the Q output of 221 is connected to one of the inputs of NOR gate 233, the Q output of 221 must be at a low level when power is initially applied in order to prevent the cross coupled latch 101 from being reset at the same time as an attempted setting of the latch is occuring with the application of the PUC pulse. Therefore, the PUC pulse is also connected to the clear input CLR, of flip flop 221 so as to force its Q output to an inactive low state during a high level state of the PUC pulse so as to allow the PUC pulse to set the cross coupled latch 101 without interference. After a short period of time, as determined by the time constant derived from the resistance of transistor 111 and capacitor 110, the PUC pulse returns to a logic zero state, minus VSS, enabling flip flop 221 to change states in response to the reset signal which is responsive to a clock pulse from the output of the first stage 221 of the prescaler 100. The clock pulse output from the first stage 220 occurs after counting down a predetermined number of pulses of clock output from the oscillator system 120, providing adequate time for the oscillator to have achieved a stable operating state before the cross coupled latch 101 is reset. When the latch is reset, its output causes the transistors 203 and 204 to turn off, removing the shunt from across resistor 202, thereby returning the output resistance to its normal sustaining value, and reducing the current drain on the battery while maintaining oscillation. Alternatively, the latch 101 may be comprised of cross coupled NAND gates, or of any alternative set-reset latch circuitry arrangement.

Referring to FIG. 5*b*, an alternative embodiment of the oscillator system with FIG. 5*a* is shown with corresponding elements and functional blocks identically numbered. FIG. 5*b* is identical to FIG. 5*a* with the exception that the change in the effective gain of the amplifier is not accomplished by changing the value of the output resistance, resistors 201 and 202 of FIG. 5*a*. Instead, there is a fixed resistance in the output formed by resistor 309 between amplifier output node 310 and oscillator output node 311. The gain of the amplifier is modified by effectively increasing the size of the amplifier transistors 303 and 307 by switching in a parallel shunt amplifier comprised of transistors 302 and 306. The transistor 302 is connected in parallel with the transistor 303, and the transistor 306 is connected in parallel with the transistor 307, with the drains and the gates of the transistors 302 and 306 connected in parallel with the drains and gates of transistors 303 and 307, respectively. When the transistors 301 and 308 are turned on responsive to the output of the latch 101, the sources of transistors 302 and 306 will be effectively connected in parallel with the sources of transistors 303 and 307, respectively. That is, when the transistors 301 and 308 are turned on, the sources of transistors 302 and 306, respectively, will be connected to the VSS and ground power supply rails, respectively. Transistors 304 and 305 correspond to transistors 205 and 206 in FIG. 5*a*, and provide a very high impedance bias voltage across the amplifier transistors 302, 303, 306, and 307. The transistors 301 and 308 will be turned on initially when the power is supplied and will subsequently be turned off when the prescaler flip flop 221 outputs a reset pulse so as to clear the latch 101, in the manner as described with reference to FIG. 5*a*. When this occurs, the transistor 301 is deactivated by the output of NOR gate 233, and the transistor 308 is deactivated by the output of NOR gate 232.

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is, therefore, contemplated that the appended claims will cover any such modifications or embodiments as fall within the true scope of the invention.

What is claimed is:

1. An oscillator system comprising:

an oscillator means for generating repetitive oscillator signals having a resonance means and a selectable gain integrated injection logic amplifier operatively connected therewith, the gain of said selectable gain amplifier being directly proportional to an injection current;

a latch circuit having a set state and a reset state;

a power source for said oscillator system;

a power up clear means responsive to the connection of said power source to said oscillator system for setting said latch circuit;

a counting means responsive to said oscillator signals for resetting said latch circuit upon receipt of a predetermined number of said oscillator signals; and a current regulator means responsive to said state of said latch circuit for causing said injection current of said selectable gain amplifier to have a high value when said latch circuit is in said set state and a low value when said latch circuit is in said reset state, whereby said selectable gain amplifier has a high gain when said latch circuit is in said set state and a low gain when said latch circuit is in said reset state.

2. An oscillator system comprising:

an oscillator means for generating repetitive oscillator signals having a resonance means and a selectable gain complimentary metal oxide semiconductor amplifier having a variable series output resistor, the gain of said selectable gain amplifier being inversely proportional to the resistance of said variable series output resistor;

a latch circuit having a set state and a reset state;

a power source for said oscillator system;

a power up clear means responsive to the connection of said power source to said oscillator system for setting said latch circuit;

a counting means responsive to said oscillator signals for resetting said latch circuit upon receipt of a predetermined number of said oscillator signals; and a resistance control means responsive to said state of said latch circuit for causing said variable series output resistor to have a low resistance when said latch circuit is in said set state and a high resistance when said latch circuit is in said reset state, whereby said selectable gain amplifier has a high gain when said latch circuit is in said set state and a low gain when said latch circuit is in said reset state.

3. The oscillator system as claimed in claim 2, wherein:

said variable series output resistor comprises a first fixed resistance portion connected in series with a second fixed resistance portion; and said resistance control means comprises means for shorting said first fixed resistance portion when said latch circuit is in said set state.

4. A portable, battery operable electronic watch having a display and an oscillator system comprising:

an oscillator means for generating repetitive oscillator signals having a resonance means and a selectable gain integrated injection logic amplifier operatively connected therewith, the gain of said selectable gain amplifier being directly proportional to an injection current;

a latch circuit having a set state and a reset state;

a power source for said oscillator system;

a power up clear means responsive to the connection of said power source to said oscillator system for setting said latch circuit;

a counting means responsive to said oscillator signals for resetting said latch circuit upon receipt of a predetermined number of said oscillator signals; and a current regulator means responsive to said state of said latch circuit for causing said injection current of said selectable gain amplifier to have a high value when said latch circuit is in said set state and a low value when said latch circuit is in said reset state, whereby said selectable gain amplifier has a high gain when said latch circuit is in said set state and a low gain when said latch circuit is in said reset state.

5. A portable, battery operable electronic watch having a display and an oscillator system comprising:

an oscillator means for generating repetitive oscillator signals having a resonance means and a selectable gain complimentary metal oxide semiconductor amplifier having a variable series output resistor, the gain of said selectable gain amplifier being inversely proportional to the resistance of said variable series output resistor;

a latch circuit having a set state and a reset state;

a power source for said oscillator system;

a power up clear means responsive to the connection of said power source to said oscillator system for setting said latch circuit;

a counting means responsive to said oscillator signals for resetting said latch circuit upon receipt of a predetermined number of said oscillator signals; and a resistance control means responsive to said state of said latch circuit for causing said variable series output resistor to have a low resistance when said latch circuit is in said set state and a high resistance when said latch circuit is in said reset state, whereby said selectable gain amplifier has a high gain when said latch circuit is in said set state and a low gain when said latch circuit is in said reset state.

6. A portable, battery operable electronic watch according to claim 5, wherein:

an oscillator means for generating repetitive oscillator signals having a resonance means and a selectable gain complimentary metal oxide semiconductor amplifier having a variable series output resistor, the gain of said selectable gain amplifier being indirectly proportional to the resistance of said variable series output resistor;

a latch circuit having a set state and a reset state;

a power source for said oscillator system;

a power up clear means responsive to the connection of said power source to said oscillator system for setting said latch circuit;

a counting means responsive to said oscillator signals for resetting said latch circuit upon receipt of a predetermined number of said oscillator signals; and a resistance control means responsive to said state of said latch circuit for causing said variable series output resistor to have a low resistance when said latch circuit is in said set state and a high resistance when said latch circuit is in said reset state, whereby said selectable gain amplifier has a high gain when said latch circuit is in said set state and a low gain when said latch circuit is in said reset state.

* * * * *